US006948992B2

(12) United States Patent
Cha et al.

(10) Patent No.: US 6,948,992 B2
(45) Date of Patent: Sep. 27, 2005

(54) FIELD EMISSION DISPLAY AND METHOD FOR FORMING NEGATIVE HOLES OF THE SAME

(75) Inventors: Jae-Cheol Cha, Seoul (KR); Kyu-Won Jung, Anyang (KR); Ho-Su Han, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 358 days.

(21) Appl. No.: 10/196,930

(22) Filed: Jul. 18, 2002

(65) Prior Publication Data

US 2003/0042842 A1 Mar. 6, 2003

(30) Foreign Application Priority Data

Aug. 29, 2001 (KR) ..... 2001-52602

(51) Int. Cl.[7] ..... H01J 9/00; H01J 9/24

(52) U.S. Cl. ..... 445/24

(58) Field of Search ..... 445/24; 313/495

*Primary Examiner*—Vip Patel
*Assistant Examiner*—Anthony Perry
(74) *Attorney, Agent, or Firm*—McGuireWoods LLP

(57) ABSTRACT

In a method for forming negative holes of a field emission display, a plurality of line patterns are first printed on a substrate, and then dried. The printing and drying of the line patterns are repeated until the line patterns are elevated to a predetermined height, then dot patterns are printed between the line patterns on the substrate and dried. The printing and drying of the dot patterns are repeated until the dot patterns are elevated to a predetermined height to define the negative holes enclosed by the line and dot patterns, and the line and dot patterns are simultaneously baked.

8 Claims, 4 Drawing Sheets

FIELD EMISSION DISPLAY AND METHOD FOR FORMING NEGATIVE HOLES OF THE SAME

CROSS REFERENCE TO RELATED APPLICATION

This application is based on application No. 2001-052602 filed with the Korea Patent Office on Aug. 29, 2001, of which content is hereby incorporated by reference.

BACKGROUND OF THE INVENTION

1. Field of the Invention

The present invention relates to a field emission display, and more particularly, to a method for forming negative holes of the field emission display.

2. Description of the Related Art

Generally, screen-printing prints patterns designed on a screen of silk or other fine mesh, with certain areas coated with an impermeable substance. The paste is forced through the mesh onto the printing surface, leaving the coated area clean. Such a screen-printing is used in fabricating a low-voltage-driven flat panel display such as a liquid crystal display (LCD), a field emission display (FED), a plasma display panel (PDP), and a vacuum fluorescent display (VFD).

One application of screen-printing is the fabrication of the FED, which will be described hereinafter.

The FED is designed to realize an image by emitting electrons from an emitter by generating a voltage difference between a cathode electrode and a gate electrode and letting the electrons strike corresponding red R, green G, and blue B phosphors formed on an anode electrode.

The emitter is formed on the cathode electrode exposed through negative holes of an insulating layer elevated to a predetermined height higher than the cathode electrode. Screen-printing is used to form the negative holes.

When forming the insulating layer on a substrate having the cathode electrode formed thereon, the insulating layer should be provided with negative holes for exposing the portion of the cathode electrode, because the emitter should be formed on a certain portion of the cathode electrode.

Accordingly, as shown in FIG. 1, a screen mask (not shown) provided with a photoresist layer corresponding to the negative holes NH is aligned with the substrate 122 on which the cathode electrode 120 is formed. Insulating paste is forced and squeezed through the screen mask onto the substrate 122 to print the insulating layer 124 on the substrate 122. At this point, on a portion of the substrate 122, which corresponds to the photoresist layer, the insulating paste is not printed to form negative holes NH.

Although such screen-printing is not costly and provides a simple process, it still has several problems.

When the paste is printed onto the substrate by a squeezing process through the screen mask, the paste may be blurred on the substrate due to the surface tension of the paste.

Accordingly, an edge portion 124*a* of the insulating layer 124 printed on the substrate 122 is blurred toward the inner side of the negative holes, making it difficult to form the negative hole NH having a diameter of less than 100 $\mu$m. In addition, this deteriorates the uniformity of the emitter patterns printed on a surface of the cathode electrode 120 exposed through the negative hole NH, thereby deteriorating the quality of the FED.

This phenomenon also occurs when the insulating layer 124 is printed after the emitters (not shown) are first printed. When the pattern size of the emitters is not uniform, the amount of electron coming from each emitter becomes different. This results in ununiform luminescence, thereby deteriorating the quality of the field emission display.

SUMMARY OF THE INVENTION

Therefore, the present invention has been made in an effort to solve the above problems.

It is a first objective of the present invention to provide a method for precisely forming negative holes.

It is a second objective of the present invention to provide an FED having such negative holes formed precisely.

To achieve the first objective, the present invention provides a method for forming negative holes, comprising the steps of printing plural line patterns on a substrate using a paste; drying the line patterns; repeating the printing and drying steps until the line patterns are elevated to a predetermined height; printing plural dot patterns in a perpendicular direction with respect to the line patterns between the line patterns on the substrate using the paste; drying the dot patterns; repeating the printing and drying steps of the dot patterns until the dot patterns are elevated to a predetermined height to define the negative holes enclosed by the line and dot patterns; and baking the line and dot patterns.

Preferably, a width of each of the negative holes is less than 100 $\mu$m, and the negative holes are formed in one of a circular-shape, an elliptical-shape, and a polygonal-shape.

Preferably, the printing of the line patterns is performed in a lengthwise direction of the line patterns.

To achieve the second objective, the present invention provides a field emission display having negative holes formed according to the above-described negative-hole-forming process.

The field emission display comprises upper and lower substrates disposed facing each other; a cathode electrode formed on the lower substrate; an insulating layer provided with the negative holes defined by the line and dot patterns; an emitter formed on the cathode electrode exposed through the negative holes; a gate electrode formed on the insulating layer; an anode electrode formed on the upper substrate; and a phosphor layer formed on the anode electrode.

According to another embodiment, the present invention provides a method for forming negative holes of a field emission display, comprising the steps of printing plural line patterns on a substrate using a paste; printing plural dot patterns between the line patterns on the substrate using the paste; drying the line and dot patterns; repeating the steps of printing the plural line patterns, printing the dot patterns, and drying the line and dot patterns, until the line and dot patterns are elevated to a predetermined height, thereby obtaining a predetermined depth of the negative holes defined by the line and dot patterns; and baking the line and dot patterns.

Generally, the paste used for the printing is composed of a solvent and a solute such that the paste has an absorptive property when it goes through a drying process. Therefore, the paste printed on the substrate to define the line and dot patterns has an absorptive property after the drying step.

Accordingly, when a new identical pattern is printed on the previously printed/dried dot and line patterns using the paste, the solvent of the new identical pattern is absorbed in the already printed and dried dot and line patterns, thereby retaining the solute of the new identical pattern on the previously printed and dried dot and line patterns.

This prevents the edge portion of the line and dot patterns from blurring to the area of the negative holes, making it possible to precisely form the negative holes each having a width of less than 100 μm, particularly of about 30–50 μm.

As the negative holes are precisely formed, the emitters formed on the cathode electrode through the negative holes can be also precisely formed, thereby improving the luminescence uniformity of the field emission display.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described in detail with reference to the accompanying drawings.

Figure 1:
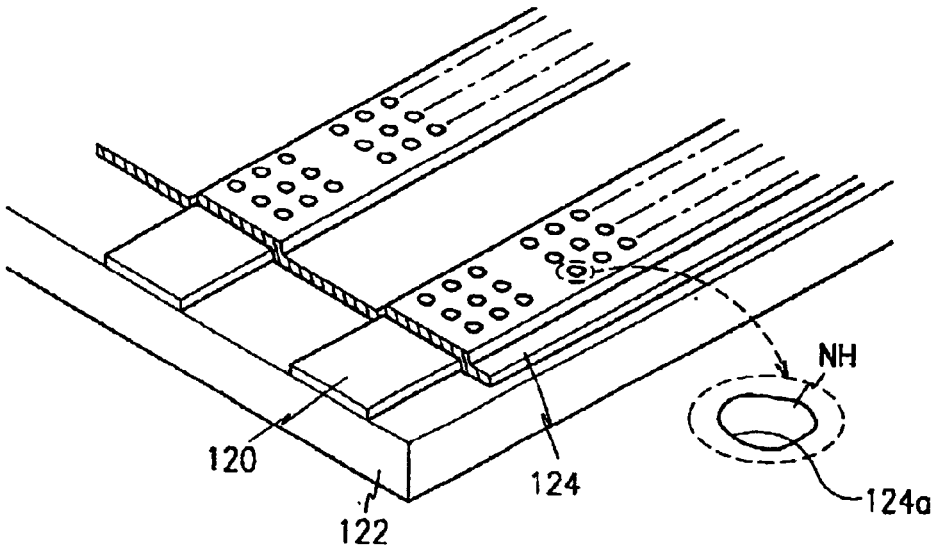
FIG. 1 (Prior art)
FIG. 1 is a partial perspective view of an FED having negative holes formed by conventional screen-printing.
Figure 2:
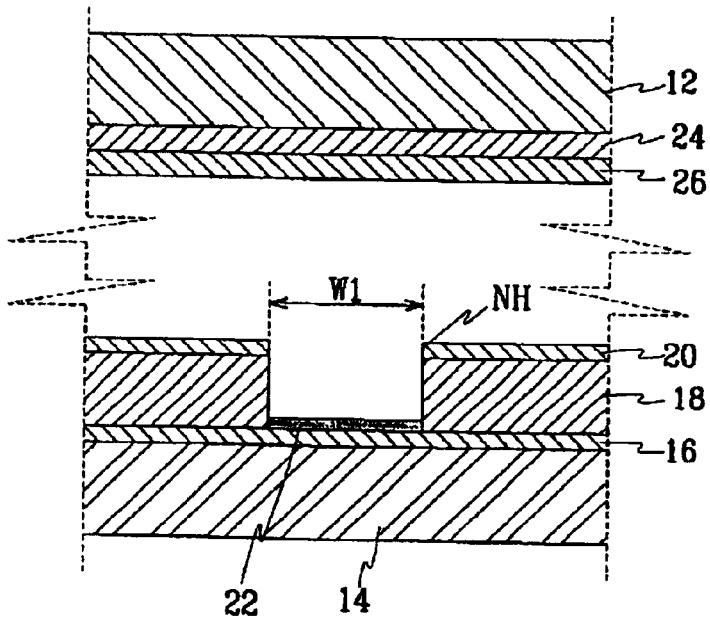
FIG. 2 is a sectional view of an FED with negative holes formed according to a method of the present invention.
Figure 3:
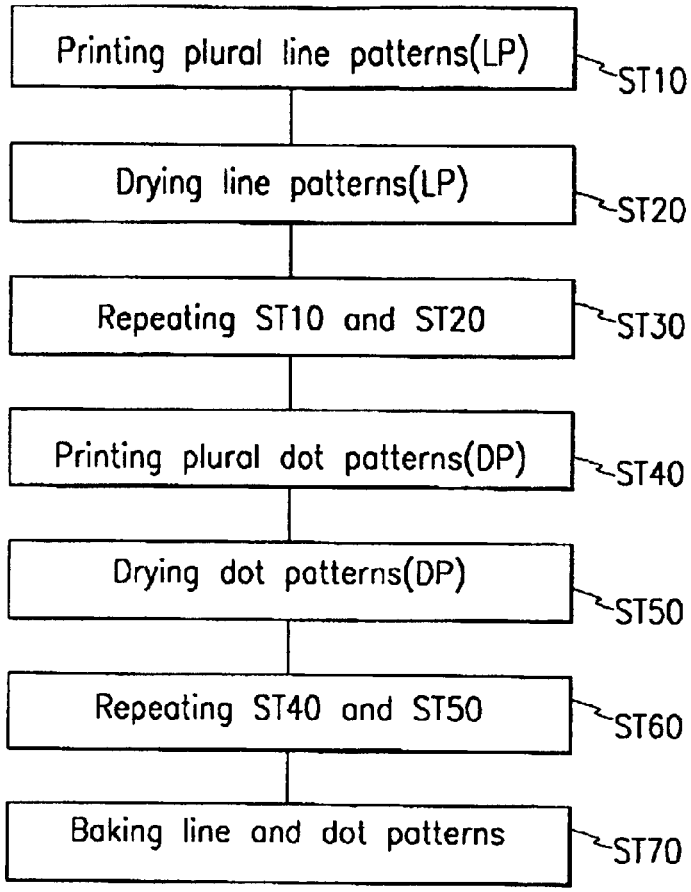
FIG. 3 is a block diagram illustrating a process for forming negative holes according to a preferred embodiment of the present invention.

FIG. 2 shows an FED with negative holes formed according to a method of the present invention.

A field emission display comprises an upper substrate 12 and a lower substrate 14 that are disposed to define an inner space therebetween.

A cathode electrode 16 having plural line patterns is disposed on the lower substrate 14, and an insulating layer 18 is formed on the cathode electrode 16 to a predetermined height. The insulating layer 18 is provided with plural negative holes NH for exposing parts of the line patterns of the cathode electrode 16. A gate electrode 20 having plural line patterns intersecting the line patterns of the cathode electrode 16 at right angles is formed on the insulating layer 18 except for a portion where the negative holes NH are formed. Planar emitters 22 are formed on the exposed line patterns of the cathode electrode 16 through the negative holes NH. An anode electrode 24 having plural line patterns is formed on the upper substrate 12 in a direction in parallel with the cathode electrode 16. Formed on the anode electrode 24 is a phosphor layer 26, which is excited by the electrons emitted from the emitter 22.

The emitters 22 are formed of a carbon-based material such as a carbon nanotube, graphite, diamond-like carbon, carbon fiber and the like, and are provided with a planar surface. Such a carbon-based material emits the electrons when a voltage difference higher than a critical voltage between the cathode and gate electrodes 16 and 20 is generated. The critical voltage means a voltage at which the electron emission starts. The critical voltage is different depending on the material used for the emitters 22.

The gate electrode 20 controls the amount of electrons emitted from the emitter 22, and it is used as a control electrode for controlling the convergence length of the electrons striking the phosphor layer 26.

If a driving voltage is applied to the cathode electrode 16 and the gate electrode 20 to make a voltage difference therebetween higher than the critical voltage, the emitters 22 emits the electrons. The emitted electrons are directed toward the phosphor layer 26 by the voltage applied to the anode electrode 24 to excite the phosphor layer 26.

A method for forming the negative holes according to a preferred embodiment of the present invention will be described hereinafter with reference to FIGS. 3, 4, 5, 6 and 7.

First, the lower substrate 14 on which the cathode electrode 16 is formed is fixed on a printing apparatus (not shown), and an insulating paste is squeezed through a screen mask (not shown) onto the cathode electrode 16 to print plural line patterns LP (ST 10).

At this point, the squeezing is preferably performed in a lengthwise direction of the line patterns LP so that precise patterns can be printed.

The insulating paste may be prepared by mixing a solute formed by mixing frit with powder and a vehicle that is produced by mixing a solvent such as Terpineol, butyl carbitol BC, and butyl carbitol acetate BCA, with a binder such as ethyl cellulous EC or nitro cellulous TC.

Figure 4:
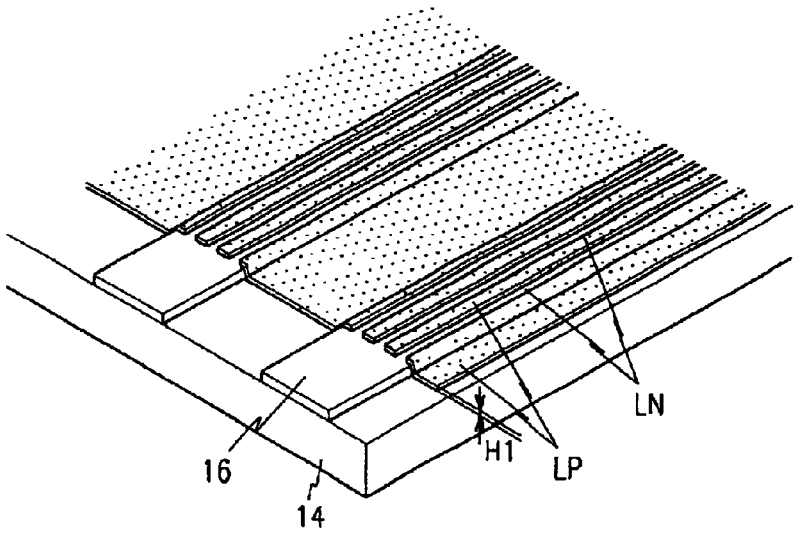
FIG. 4 is a partial perspective view of an FED when step 10 of FIG. 3 is completed.

The reference character H1 in FIG. 4 indicates a height of the line patterns LP when it is printed once.

After printing the line patterns LP as shown in FIG. 4, they are dried at a temperature of about 120–150° C. for 10–30 minutes so that the line patterns LP have a sponge-like absorptive property(ST 20).

Figure 5:
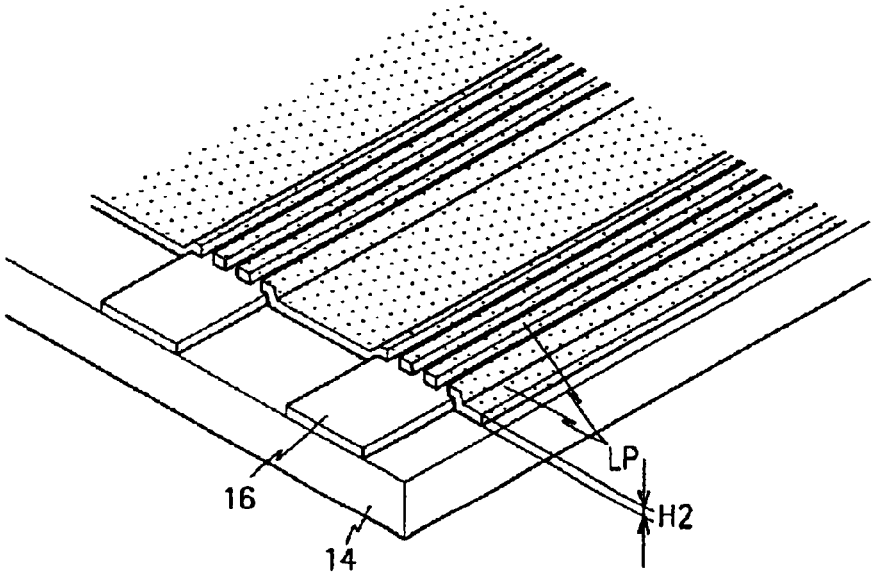
FIG. 5 is a partial perspective view of an FED when step 30 of FIG. 3 is completed.

Then ST 10 and ST 20 are alternately repeated to elevate the line patterns LP to a predetermined height H2 as shown in FIG. 5 (ST 30).

As described above, when new line patterns LP are repeatedly printed on the already printed and dried line patterns LP, since the solvent of the new line patterns is absorbed in the already printed and dried line patterns LP, only the solute of the new line patterns remains on the already printed and dried line patterns LP, and the size and shape of the new line patterns remain the same as those of the already printed and dried line patterns.

FIG. 5 shows plural line patterns LP having a predetermined height H2, realized in ST 30.

Figure 6:
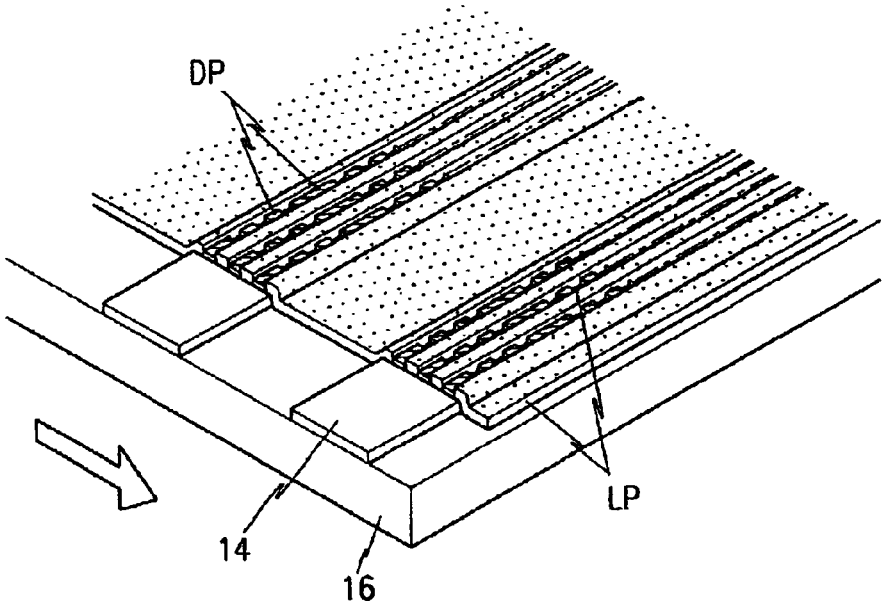
FIG. 6 is a partial perspective view of an FED when step 40 of FIG. 3 is completed.

Next, insulating paste is further squeezed through a screen mask (not shown) onto the substrate between the line patterns LP to form plural dot patterns DP that are perpendicular to the line patterns as shown in FIG. 6 (ST 40), after which the dot patterns DP are dried at a temperature of about 120–150° C. for 10–30 minutes to have an absorptive sponge-like property (ST 50).

STs 40 and 50 are multiple times so as to elevate the dot patterns DP to a height identical to H2 of the line patterns LP (ST 60).

That is, when new dot patterns DP are repeatedly printed on the already printed and dried dot patterns DP, since the solvent of the new dot patterns is absorbed in the previously printed and dried dot patterns DP, only the solute of the new dot patterns remains on the previously printed and dried line patterns LP.

Figure 7:
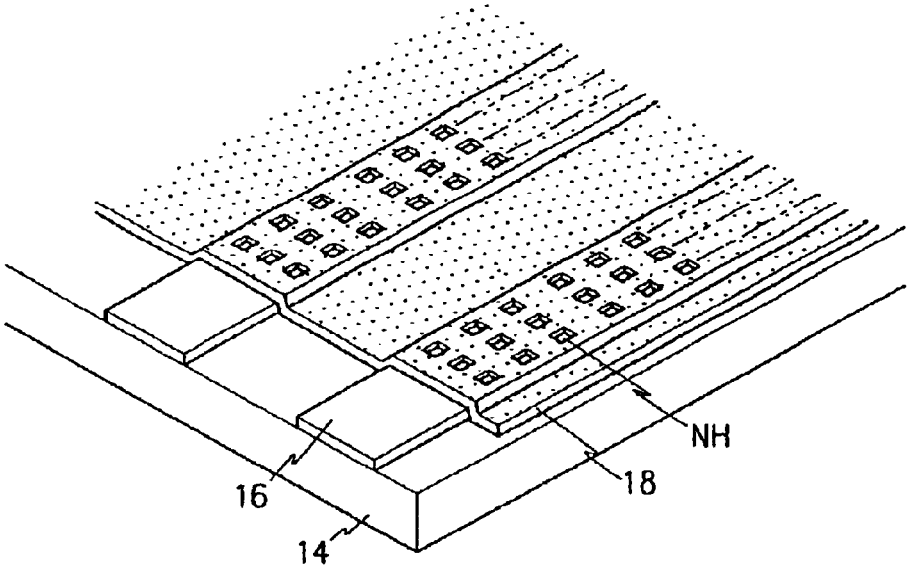
FIG. 7 is a partial perspective view of an FED when step 60 of FIG. 3 is completed.

As a result, as shown in FIG. 7, a plurality of negative holes having a uniform pattern width W1 defined by the line patterns LP and the dot patterns DP are formed, and the line and dot patterns are simultaneously baked (ST 70).

This method makes it also possible to form a variety of hole shapes such as a circular-shape, an elliptical-shape, and a polygonal-shape by changing the design of the dot patterns DP.

After forming the hole, emitter paste is forced through a screen mask onto the cathode electrode exposed through the negative holes NH to form planar emitters 22 on the cathode electrode 16 exposed through the negative holes NH. Then, the gate electrode 20 is printed on the insulating layer 18, and completes the pattern-forming process on the lower substrate 14.

The emitter paste is formed of a mixture of a carbon-based electron emission material selected from the group consisting of graphite, carbon fiber, diamond-like carbon, and carbon nanotube, and an additive such as frit, and a binder.

As described above, according to the inventive negative-hole-forming method, the negative holes NH can be formed in exact design measurements, forming precise planar emitters 22 on the surface of the cathode electrode 16 exposed through the negative holes NH. Thus, we can obtain uniform electric field emission.

Figure 8:
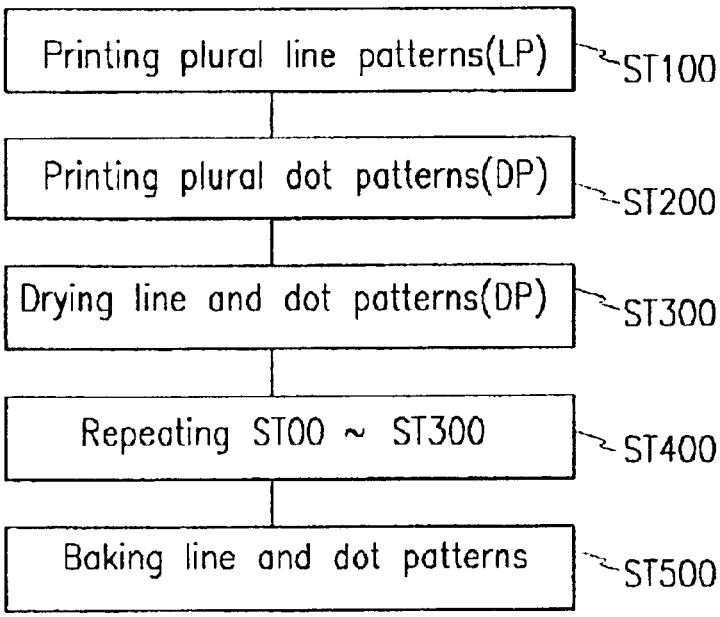
FIG. 8 is a block diagram illustrating a process for forming negative holes according to another preferred embodiment of the present invention.

FIG. 8 shows a method for forming negative holes according to another embodiment of the present invention.

Plural line patterns are first printed on a substrate (ST 100). Plural dot patterns DP are printed on the substrate between the line patterns (ST 200), and then the line and dot patterns are dried (ST 300). STs 100 through 300 are repeated so as to elevate the line and dot patterns to a predetermined height, thereby obtaining a predetermined depth of negative holes NH (ST 400). Then the line and dot patterns are simultaneously baked (ST500).

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method for forming a negative hole, comprising steps of:

a) printing a plurality of line patterns on a substrate;

b) drying the line patterns;

c) repeating step a) and step b) until the line patterns are elevated to a predetermined height;

d) printing dot patterns in a direction perpendicular to the line patterns between the line patterns on the substrate;

e) drying the dot patterns;

f) repeating step d) and step e) until the dot patterns are elevated to a predetermined height to define the negative holes enclosed by the line patterns and the dot patterns; and g) baking the line patterns and the dot patterns.

2. The method of claim 1, wherein the negative hole is less than 100 $\mu$m wide.

3. The method of claim 1, wherein the negative hole is formed in one of a circular-shape, an elliptical-shape, and a polygonal-shape.

4. The method of claim 1, wherein the line patterns are printed in a lengthwise direction of the line patterns.

5. A method for forming a negative hole of a field emission display, comprising steps of:

a) printing a plurality of line patterns on a substrate using paste;

b) printing dot patterns in a direction perpendicular to the line patterns between the line patterns on the substrate;

c) drying the line patterns and the dot patterns;

d) repeating the steps of a), b) and c) until the line patterns and the dot patterns are elevated to a predetermined height, thereby obtaining a predetermined depth of the negative holes defined by the line patterns and the dot patterns; and e) baking the line patterns and the dot patterns.

6. The method of claim 5, wherein each of the negative holes is less than 100 $\mu$m wide.

7. The method of claim 5, wherein the negative holes are formed in one of a circular-shape, an elliptical-shape, and a polygonal-shape.

8. The method of claim 5, wherein the line patterns are printed in a lengthwise direction of the line patterns.

* * * * *